US009212562B2

(12) United States Patent
Burt et al.

(10) Patent No.: US 9,212,562 B2
(45) Date of Patent: Dec. 15, 2015

(54) BAYONETED ANTI-ROTATION TURBINE SEALS

(75) Inventors: Jonathan P. Burt, Sturbridge, MA (US); Jonathan Perry Sandoval, East Hartford, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 732 days.

(21) Appl. No.: 13/551,818

(22) Filed: Jul. 18, 2012

(65) Prior Publication Data

US 2014/0023509 A1 Jan. 23, 2014

(51) Int. Cl.
*F01D 11/00* (2006.01)
*F01D 5/30* (2006.01)

(52) U.S. Cl.
CPC ..... *F01D 5/3015* (2013.01); *Y10T 29/4932* (2015.01)

(58) Field of Classification Search
CPC ..... F01D 5/082; F05D 2260/30
USPC ..... 416/196 R, 204 A, 218, 220 R, 244 A, 416/244 R, 248
See application file for complete search history.

(56) References Cited

U.S. PATENT DOCUMENTS

| | | | | |
|---|---|---|---|---|
| 5,257,909 | A * | 11/1993 | Glynn et al. | 416/220 R |
| 5,472,313 | A * | 12/1995 | Quinones et al. | 415/115 |
| 6,106,234 | A | 8/2000 | Gabbitas | |
| 7,040,866 | B2 * | 5/2006 | Gagner | 416/220 R |
| 7,824,157 | B2 * | 11/2010 | Buisson et al. | 416/220 R |
| 2010/0215501 | A1 | 8/2010 | Ammann | |
| 2012/0027598 | A1 * | 2/2012 | Caprario | 416/193 R |
| 2012/0177485 | A1 | 7/2012 | Virkler et al. | |
| 2012/0177495 | A1 | 7/2012 | Virkler et al. | |

OTHER PUBLICATIONS

International Search Report and Written Opinion for International Application No. PCT/US2013/051083 completed on Oct. 15, 2013.
International Preliminary Report on Patentability for PCT Application No. PCT/US2013/051083, mailed Jan. 29, 2015.

* cited by examiner

*Primary Examiner* — Igor Kershteyn
*Assistant Examiner* — Woody A Lee, Jr.
(74) *Attorney, Agent, or Firm* — Carlson, Gaskey & Olds P.C.

(57) ABSTRACT

An assembly for connecting a coverplate and a rotor includes a first rotor for use in a rotating engine; a first cover mounted to the first rotor, wherein the rotor and the cover create a space there between, the space for having cooling air therein; and a lock assembly for preventing the cover from rotating circumferentially or moving axially away from the rotor if mounted to the to the rotor wherein the cover is sealed against the rotor.

14 Claims, 7 Drawing Sheets

BAYONETED ANTI-ROTATION TURBINE SEALS

TECHNICAL FIELD

This invention relates to disks for gas turbine engines and particularly to coverplates that fit adjacent the recesses in the disks to provide a cooling path there between.

BACKGROUND OF THE INVENTION

Early coverplates were used as windage covers disposed upon rotating gas turbine engine disks. More modern coverplates are also used to attain a cooling of the disk. An axial extension of the cover may extend into a broach area of a turbine disk (or rotor) radially outside the disk rim and radially supported by the blade. The coverplate is spaced radially from the disk to provide a dead ended annular space. Cooler air migrates to this space and insulates the disk rim from the engine's extremely hot working medium that is acting on the turbine blades. Tests have shown that this feature reduces the disk rim temperature by over 100 degree F. which increases the disk low cycle fatigue life and allows the use of less expensive material from which the disk is fabricated.

SUMMARY

According to an embodiment shown herein, an assembly for connecting a part to a rotor includes: a first rotor for use in a rotating engine; a part mounted to the first rotor; and, a lock preventing the first part from rotating circumferentially or moving axially away from the rotor if mounted to the rotor wherein the lock performs another function other than preventing the part from rotating circumferentially or moving axially away from the rotor.

According to any previous embodiment described herein, the assembly lock includes a first tab mounted to the rotor, a second tab mounted to the cover, wherein the second tab is axially aligned with the first tab; and a tooth preventing the first tab and the second tab from being unaligned with each other.

According to any previous embodiment described herein, the first tab is axially aft the second tab.

According to any previous embodiment described herein, the second tab is axially aft the first tab.

According to any previous embodiment described herein, the first tooth is attached to a sleeve.

According to any previous embodiment described herein, the sleeve encircles a hub of the first rotor.

According to any previous embodiment described herein, the tooth attaches to a second rotor.

According to any previous embodiment described herein, the first tab is axially aft of the second tab.

According to any previous embodiment described herein, the cover has a reinforced area adjacent the tab, the reinforced area for minimizing torque effects on the cover.

According to any previous embodiment described herein, the first cover is urged against the first rotor if the first tab is disposed behind the second tab.

According to any previous embodiment described herein, the first cover has a gap between adjacent teeth thereof, the gap angling axially forward and radially inwardly from an aft surface of the cover.

According to a further embodiment disclosed herein, an assembly includes a first rotor for use in a rotating gas turbine engine; a first cover mounted to the first rotor, wherein the rotor and the cover create a space there between, the space for having cooling air therein; and a lock assembly for preventing the cover from rotating circumferentially or moving axially away from the rotor if mounted to the to the first rotor wherein the cover is sealed against the rotor wherein the lock assembly includes; a first tab mounted to the rotor, a second tab is mounted to the cover, wherein the second tab is axially aligned with the first tab; and a tooth preventing the first tab and the second tab from being unaligned with each other.

According to any previous embodiment described herein, the first tooth is attached to a sleeve.

According to any previous embodiment described herein, the tooth attaches to a second rotor.

According to any previous embodiment described herein, the first cover is urged against the rotor if the first tab is disposed behind the second tab.

According to a still further embodiment disclosed herein, a coverplate for use with a rotor includes a plate like body, a plurality of teeth extending radially inwardly from a central opening in the body, and a thickened area axially and radially adjacent the teeth.

According to any previous embodiment described herein, the first cover has a gap between adjacent teeth thereof, the gap angling axially forward and radially inwardly from an aft surface of the cover.

According to still further embodiment described herein, disclosed herein a method of assembling a coverplate and a rotor includes the following steps: providing a first rotor for use in a rotating gas turbine engine, the rotor having a first plurality of tabs mounted thereto the first tabs having a first gap disposed between each adjacent first tab; providing a first cover having a plurality of second tabs mounted thereto the second tabs having a second gap disposed between each adjacent second tab; maneuvering the first tabs through the second gaps or the second tabs through the first gaps, and rotating the cover relative to the hug to align the first tabs and the second tabs axially.

According to any previous embodiment described herein, the method further includes filling the first gap or the second gap such that the first tabs may not rotate circumferentially relative to the second tabs.

According to any previous embodiment described herein, the method further includes filling the first gap or the second gap such that the first tabs may not rotate circumferentially relative to the second tabs nor may the cover move axially away from the rotor wherein the rotor and the cover creating a space there between, the space for having cooling air therein.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION

Figure 1:
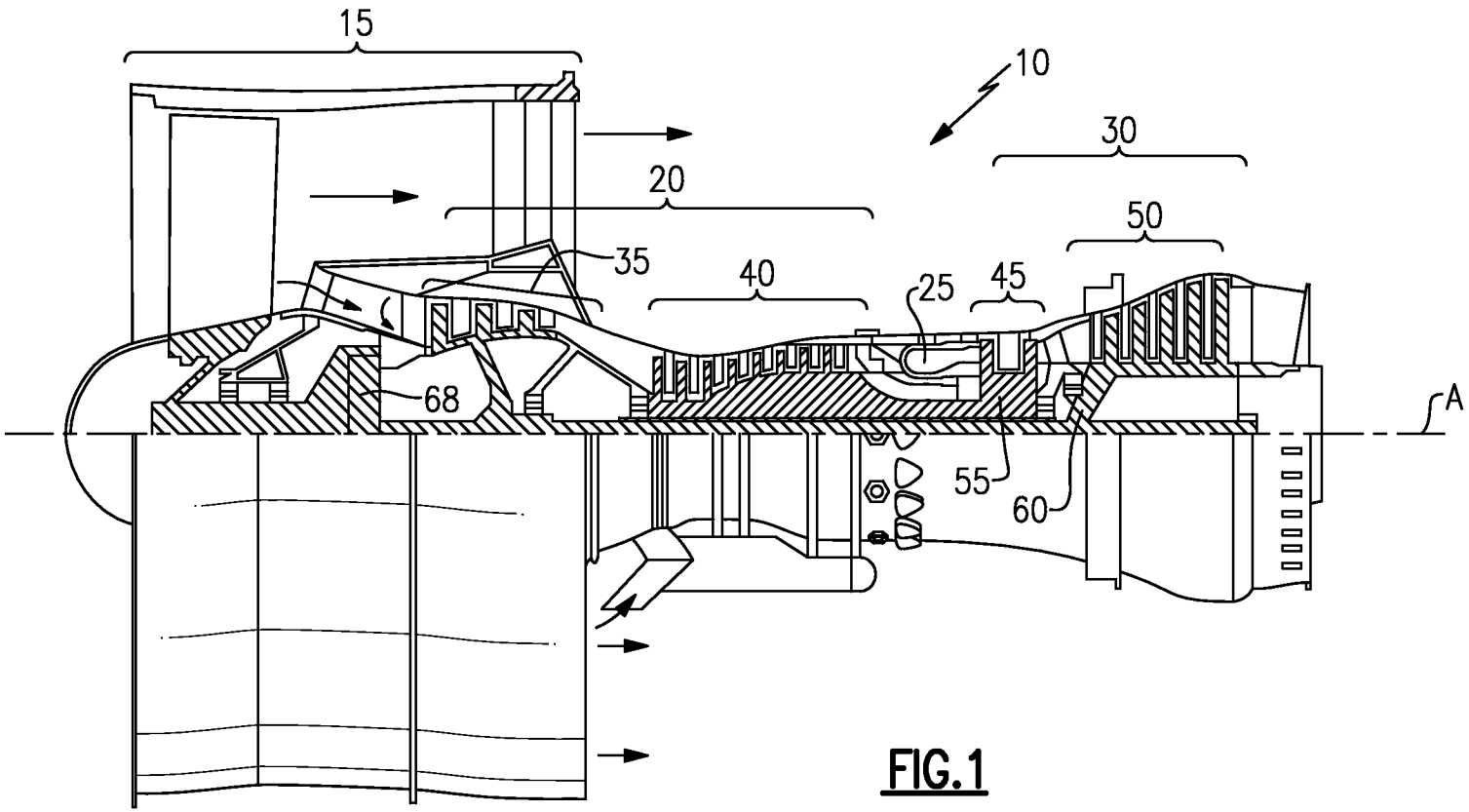
FIG. 1 shows a gas turbine engine, including non-limiting embodiment of the invention.

Referring to FIG. 1, a gas turbine engine 10 includes a fan section 15, a compressor section 20, a combustor 25 and a turbine section 30. The example compressor section 20 includes a low pressure compressor section 35 and a high pressure compressor section 40. The turbine section 30 includes a high pressure turbine 45 and a low pressure turbine 50. The high pressure compressor section 40 and the high pressure turbine 45 are supported by a high spool 55. The low pressure compressor section 35 and low pressure turbine 50 are supported on a low spool 60. Spools 55 and 60 and their attached components rotate about a main axis A. Air drawn in through the compressor section 20 is compressed and fed into the combustor 25. In the combustor 25, the compressed air is mixed with fuel and ignited to generate a high speed gas stream. This gas stream is drives the turbine section 30.

Figure 2:
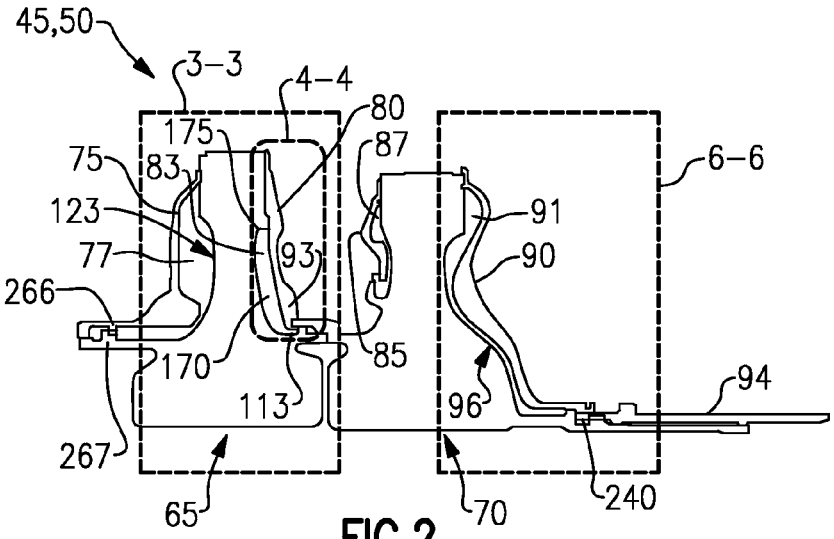
FIG. 2 is a side view of a turbine section of the engine of FIG. 1.

Referring now to FIG. 2, a depiction of a turbine assembly 45 is shown. One of ordinary skill in the art will recognize that the teachings of this invention may be used for either the high pressure turbine assembly 40 or the low pressure turbine assembly 45. Moreover, one of ordinary skill will recognize that the teachings herein can be used wherever rotors or blades need to be cooled and may include other parts of the engine like the high pressure compressor section 40, more turbine stages or other types of engines besides the gas turbine engine 10 shown herein.

Referring again to FIG. 2, a rotor assembly includes a forward rotor 65, an aft rotor 70. A forward rotor forward coverplate 75 defines a space 77 between the forward rotor forward coverplate 75 and the forward rotor 65; a forward rotor aft coverplate 80 defines a space 83 between the forward rotor aft coverplate 80 and the forward rotor 65; and, an aft rotor forward coverplate 85 defines a space 87 between the aft rotor forward coverplate 85 and the aft rotor 70. An aft rotor aft coverplate 90 defines a space 91 between the aft rotor aft coverplate 90 and the aft rotor 70. The aft rotor 70 has axially extending teeth 93 that extend forward therefrom. A sleeve 94 attaches to an aft side 96 of the aft rotor 70 as will be discussed herein.

Figure 3:
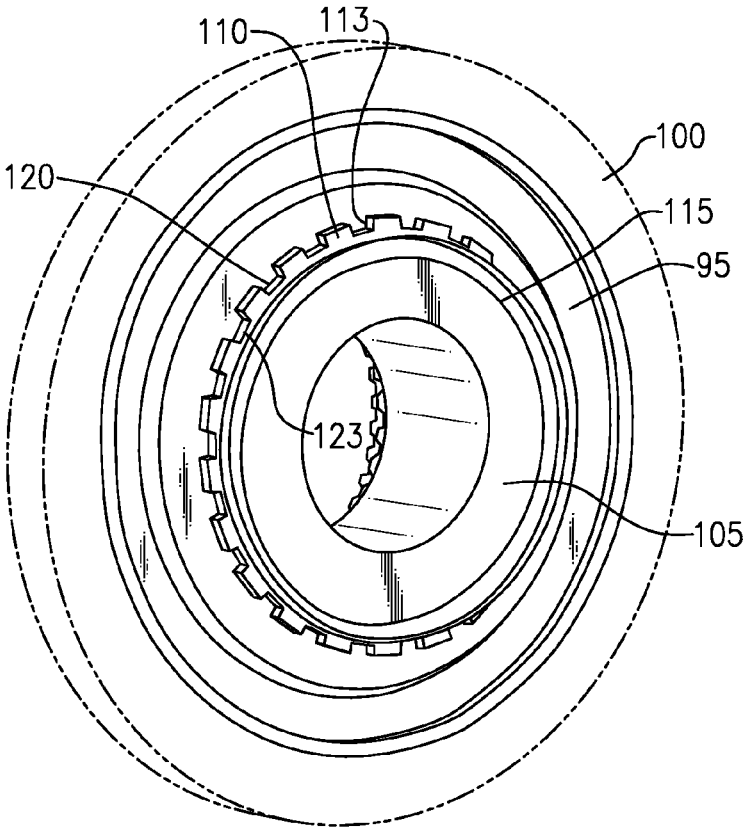
FIG. 3 is a perspective, aft view of a rotor along the line 3-3 of FIG. 2.

Referring now to FIG. 3, a perspective aft view of a forward rotor 65 is shown. The forward rotor 65 has a body 95 that has a plurality of radially extending teeth 100 (shown generically) that holds blades (not shown) as is known in the art. The forward rotor 65 has an aft hub 105 that has a plurality of aft tabs 110. The aft tabs 110 each have a forward surface 113 for engaging the aft rotor aft coverplate 90 as will be discussed herein. An area 120 between the aft tabs 110 and the body 95 receives the teeth 93 of the aft rotor 70, forward tabs 110 and the aft coverplate 80 as will be discussed herein.

Figure 4A:
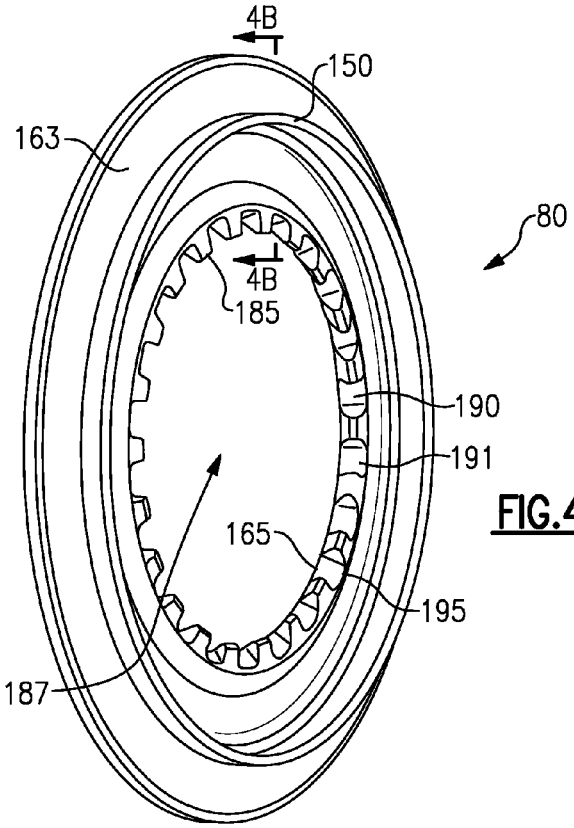
FIG. 4A is a perspective view, taken along the lines 4-4 of FIG. 2 of an aft coverplate for use with forward rotor.
Figure 4B:
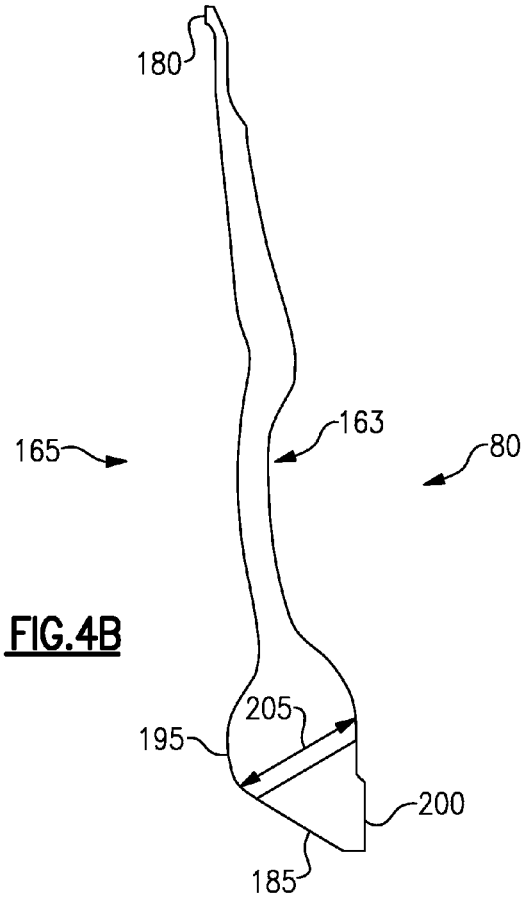
FIG. 4B is a side view of the aft coverplate taken along the lines 4B-4B of FIG. 4A.

Referring to FIG. 4A and 4B, a side view and a perspective view of the forward rotor 65 aft coverplate 80 is shown. Coverplate 80 has a body 163, a forward surface 165, cogs 185 and central opening 187. Passageways 190 are formed between adjacent cogs which extend radially inwardly. Each passageway 190 has an angled surface 191 that extends radially outwardly and axially aft from the aft surface 195 to the forward surface 165. The cogs 185 have a flat surface 200 that pushes against the forward surface 113 of the aft tabs 110 on the forward rotor 65. The coverplate 80 has an area 205 axially forward and radially inward of each cog 85, which is a thickened (or reinforced), to withstand any torque placed on the coverplate.

Figure 5:
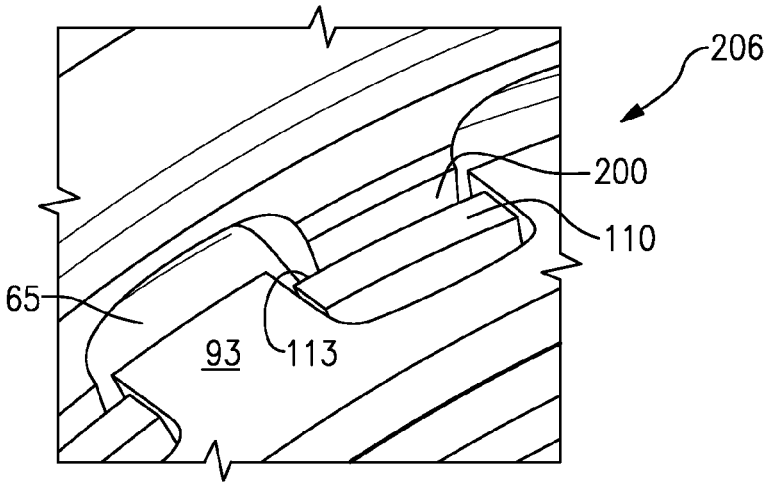
FIG. 5 is a depiction of an assembly of the forward rotor and the aft coverplate associated with the forward rotor of FIG. 2.

Referring now to FIG. 5, an assembly 206 of the aft coverplate 80, the forward rotor 65, and the aft rotor 70 is shown. The aft coverplate 80 is inserted through slots 120 between aft tabs 110. The coverplate 80 is then rotated circumferentially about the aft hub 105 so that the cogs 185 are disposed in register and axially aligned with forward surface 113 and the flat surface 200 is contacting the forward surface of aft tabs 110. Axially extending teeth 193 from the aft rotor 70 are then pushed into gaps 113 to lock the coverplate 80 axially forward the aft tabs 110 (see Also FIG. 2). The aft coverplate 80 may not now move circumferentially because of the interaction of the teeth 193 extending between the cogs 185 nor may it move axially because the disposition of the cogs 185 axially forward and in register with forward surface 113 of aft tabs 110. The teeth 193 act as a lock to lock the cogs 185 axially forward and in register with forward surface 113 of aft tabs 110. The aft coverplate 80 (like all coverplates described herein) is flexible such that as the coverplates are installed, they flex to allow the sealing surfaces 180 to seal against the forward rotor 65.

Figure 6A:
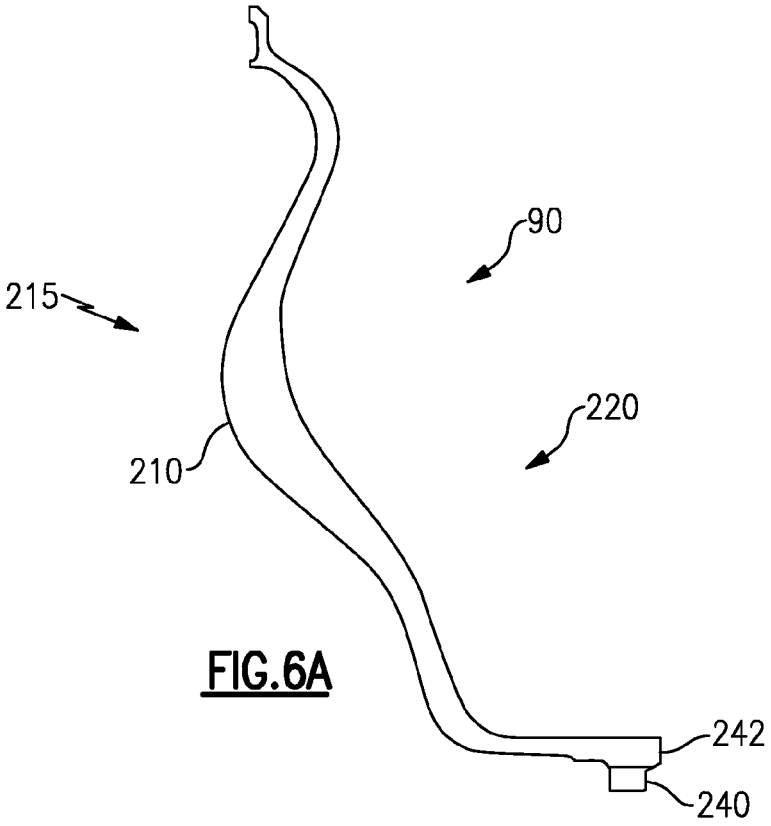
FIG. 6A is a side view taken along lines 6-6 of FIG. 6B.
Figure 6B:
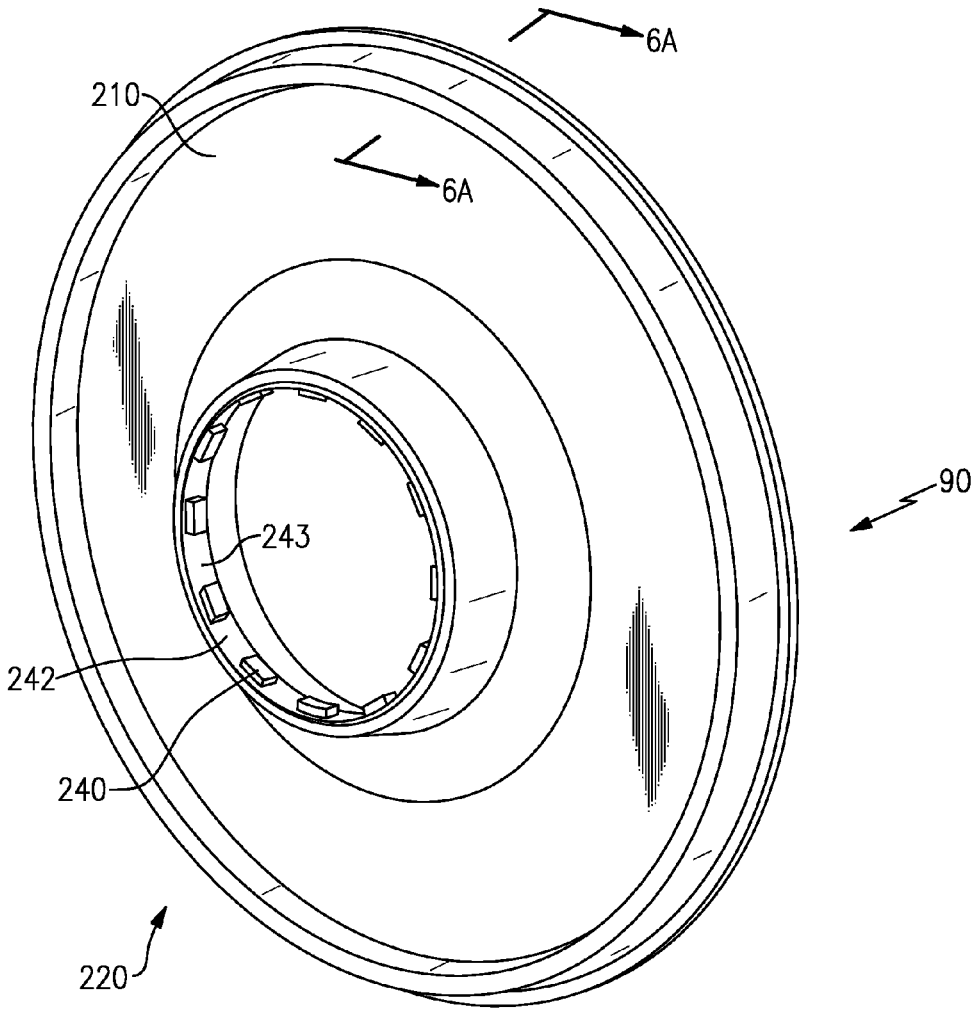
FIG. 6B is a perspective view of the coverplate of FIG. 6A.

Referring now to FIGS. 6A and 6B, a side and a perspective view of the aft rotor 70 aft cover 90 is shown. The aft rotor 70 aft cover 90 has a body 210, a forward side 215, an aft side 220. A plurality of bayonet tabs 240 extends from a radially inner portion 242 and an axially aft portion 243 of the aft rotor aft cover 90. One of ordinary skill in the art will notice that the forward rotor 65 forward coverplate 75 is constructed and interacts with the forward rotor 65 in the same manner as the aft rotor aft coverplate 90 does with the aft rotor 70 though tabs 266 in the forward coverplate 75 are disposed behind tabs 267 in the forward rotor 65.

Figure 7A:
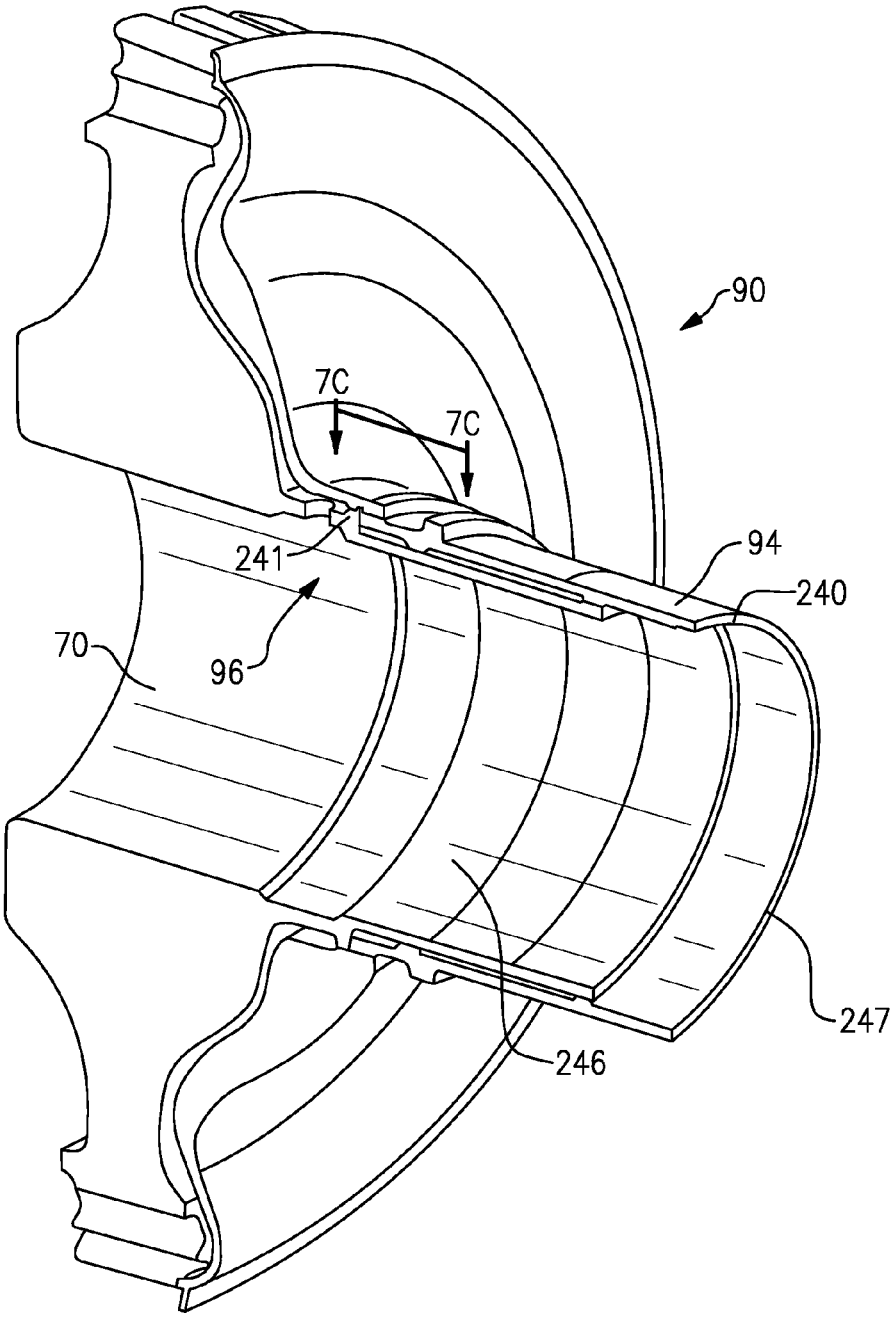
FIG. 7A, is a perspective view taken of a combination of a sleeve, an aft coverplate and the aft rotor as shown in FIG. 2.
Figure 7B:
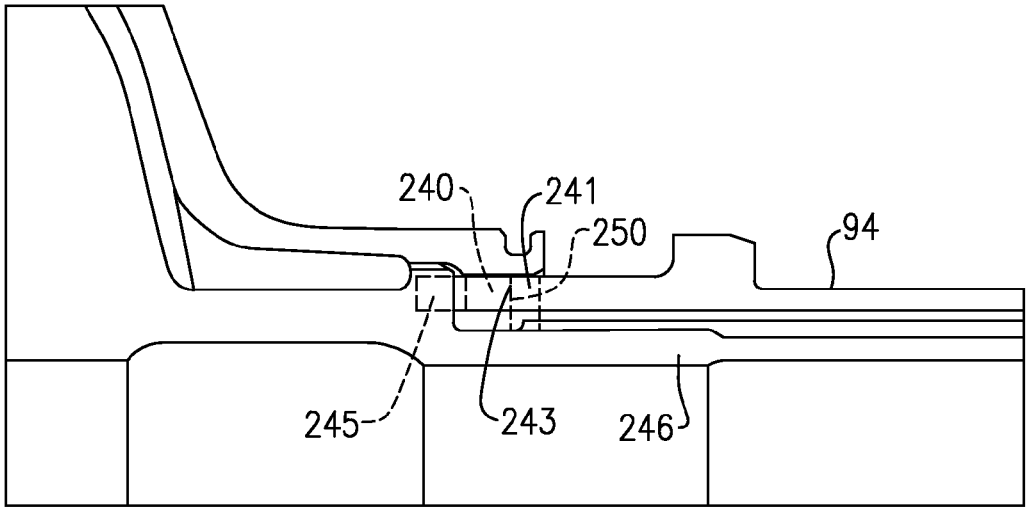
FIG. 7B, is a perspective side views taken of a combination of a sleeve, an aft coverplate and the aft rotor as shown in FIG. 2.
Figure 7C:
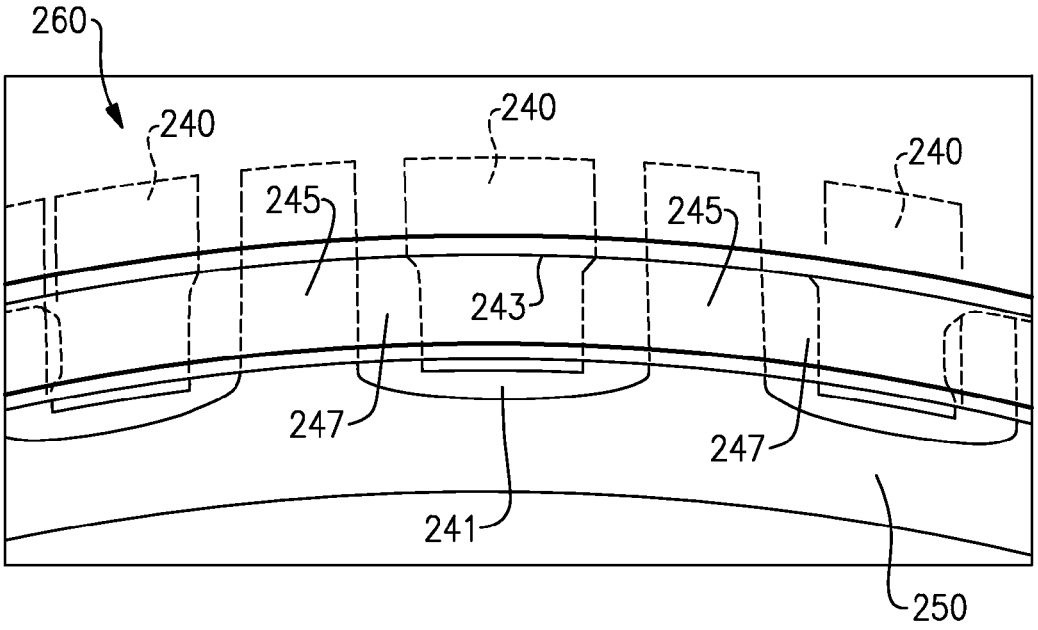
FIG. 7C, is a perspective view, partially in section, taken of a combination of a sleeve, an aft coverplate and the aft rotor taken along the lines 7C-7C of FIG. 7A.

Referring now to FIGS. 7A-7C, the aft rotor 70 is shown in conjunction with the aft rotor aft coverplate 90 and sleeve 94. Similar in construction to the forward hub 125 of the forward rotor 65, the aft rotor 65 has an aft hub 246. A plurality of aft tabs 241 extend radially outwardly from the aft hub 246. The aft tabs have a forward surface 243 for engaging the aft rotor aft coverplate 90 as will be discussed herein.

The sleeve 94 has a plurality of sprockets 245 that extend axially forward from end 250 of the sleeve 94. Gaps 246 extend between the sprockets 245.

Referring now to FIGS. 7B and 7C, an assembly 260 that includes the sleeve 94, the aft rotor 70 and the aft rotor aft coverplate 90 is shown. The bayonet tabs 240 of the aft coverplate 90 are inserted from aft through gaps 247. The coverplate 90 is then rotated circumferentially about the aft hub 246 so that the bayonet tabs 240 of the aft rotor 70 are disposed behind, axially aligned with each other and in contact with the forward surface 243 of the aft tabs 241 extending from the aft hub 246. Because, the bayonet tabs 240 are no longer in the gaps 247, the sprockets 245 are then inserted in the gaps 247 to lock the bayonet tabs 240 forward of the aft tabs 241. The aft coverplate 90 may not now move circumferentially nor may it move axially because the bayonet tabs 240 of the aft rotor 70 are disposed axially forward and in contact with the forward surface 243 of the aft tabs 241. The sprockets 245 act as a lock to lock the bayonet tabs 240 axially forward and in register with forward surface 243 of the aft tabs 241.

By using the assemblies 206, 260, a part such as a coverplate 80 or 90 may be attached to a rotor 65, 70 with a single assembly that performs another function. For instance assembly 206, which includes the aft coverplate 80, the forward rotor 65, and the aft rotor 70, acts to drive torque. Similarly, the assembly 260, which includes the sleeve 94, the aft rotor 70 and the aft rotor aft coverplate 90, acts as a heat shield and a spacer. No parts are added with the sole function of locking the rotor and the part together. Each portion of the assembly performs more than one function in the engine 100 than locking the part such as a coverplate 80 or 90 to the rotor 65 or 70.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An assembly for connecting a cover to a rotor, said assembly comprising:
- a first rotor for use in a rotating engine;
- a cover mounted to said first rotor;
- a second rotor for use in the rotating engine; and
- a lock preventing said cover from rotating circumferentially and moving axially away from said first rotor when mounted to said first rotor, wherein said lock performs another function other than preventing said cover from rotating circumferentially and moving axially away from said first rotor, wherein said lock comprises:
  - a first tab mounted to said first rotor;
  - a second tab mounted to said cover, wherein said second tab is axially aligned with said first tab; and
  - a tooth preventing said first tab and said second tab from being unaligned with each other, said tooth projecting from said second rotor.

2. The assembly of claim 1 wherein said first tab is axially aft said second tab.

3. The assembly of claim 1 wherein said second tab is axially aft said first tab.

4. The assembly of claim 1 wherein said cover has a reinforced area adjacent said second tab, said reinforced area for minimizing torque effects on said cover.

5. The assembly of claim 1 wherein said cover is urged against said first rotor when said first tab is disposed behind said second tab.

6. The assembly of claim 1 wherein said cover has a gap between adjacent teeth thereof, said gap angling axially forward and radially inwardly from an aft surface of said cover.

7. The assembly of claim 1 wherein the first rotor holds a plurality of first rotor blades and wherein the second rotor holds a plurality of second rotor blades.

8. An assembly for connecting a cover and a rotor, said assembly comprising:
- a rotor for use in a rotating gas turbine engine;
- a cover mounted to said rotor, wherein said rotor and said cover create a space there-between, said space for having cooling air therein; and
- a lock assembly for preventing said cover from rotating circumferentially and moving axially away from said rotor when mounted to said to said rotor, wherein said cover is sealed against said rotor, and wherein said lock assembly comprises:
  - a first tab mounted to said rotor;
    - a second tab mounted to said cover, wherein said second tab is axially aligned with said first tab; and
    - a tooth preventing said first tab and said second tab from being unaligned with each other, wherein said tooth is attached to a sleeve.

9. The assembly of claim 8 wherein the cover is urged against said rotor when said first tab is disposed behind said second tab.

10. The assembly of claim 8 wherein said sleeve includes a plurality of sprockets extending axially forward from an end of said sleeve, and wherein said tooth is provided by one of said sprockets.

11. A method of assembling a cover and a rotor comprising the steps of:
- providing a first rotor for use in a rotating gas turbine engine, said first rotor having a plurality of first tabs mounted thereto, said first tabs having a first gap disposed between each adjacent first tab;
- providing a cover having a plurality of second tabs mounted thereto, said second tabs having a second gap disposed between each adjacent second tab;
- maneuvering one of (1) said first tabs through said second gaps and (2) said second tabs through said first gaps;
- rotating said cover to align said first tabs and said second tabs axially; and
- filling at least one of said first gap and said second gap with one of (1) a tooth projecting from a sleeve and (2) a tooth projecting from a second rotor.

12. The method of claim 11 further comprising:
- filling at least one of said first gap and said second gap such that said first tabs may not rotate circumferentially relative to said second tabs.

13. The method of claim 11 further comprising:
- filling at least one of said first gap and said second gap such that said first tabs may not rotate circumferentially relative to said second tabs nor may said cover move axially away from said rotor.

14. The method of claim 11 wherein said sleeve includes a plurality of sprockets extending axially forward from an end of said sleeve, and wherein said tooth is provided by one of said sprockets.

* * * * *

UNITED STATES PATENT AND TRADEMARK OFFICE

CERTIFICATE OF CORRECTION

PATENT NO. : 9,212,562 B2
APPLICATION NO. : 13/551818
DATED : December 15, 2015
INVENTOR(S) : Jonathan P. Burt It is certified that error appears in the above-identified patent and that said Letters Patent is hereby corrected as shown below:

IN THE CLAIMS:

In claim 8, column 6, line 9; delete one set of "to said"

Signed and Sealed this
Twelfth Day of April, 2016

Michelle K. Lee

Michelle K. Lee
*Director of the United States Patent and Trademark Office*